United States Patent [19]

Copeland

[11] Patent Number: 4,769,159

[45] Date of Patent: Sep. 6, 1988

[54] INSTITUTIONAL SOFTENER CONTAINING CATIONIC SURFACTANT AND ORGANIC ACID

[75] Inventor: James L. Copeland, Burnsville, Minn.

[73] Assignee: Ecolab Inc., St. Paul, Minn.

[21] Appl. No.: 830,533

[22] Filed: Feb. 18, 1986

[51] Int. Cl.[4] ..... D04B 13/46

[52] U.S. Cl. ..... 252/8.8; 252/8.9; 252/8.6; 252/547; 137/268; 422/261; 422/263; 422/264; 239/310; 206/524.5; 134/36; 134/25.1

[58] Field of Search ..... 252/8.8, 8.6, 8.9, 547, 252/90; 137/268; 422/261, 263, 264; 239/310; 206/524.5; 134/36, 25.1, 29, 56 R

[56] References Cited

U.S. PATENT DOCUMENTS

| | | | |
|---|---|---|---|
| 3,330,665 | 7/1967 | Van Ness et al. | 252/174.21 |
| 3,941,713 | 2/1976 | Dawson et al. | 252/142 |
| 4,057,673 | 11/1977 | Falivene | 428/411 |
| 4,128,484 | 12/1978 | Barford et al. | 252/8.8 |
| 4,144,177 | 3/1979 | Minegishi et al. | 252/8.8 |
| 4,210,550 | 7/1980 | Cornelissens | 252/90 |
| 4,233,167 | 11/1980 | Sramek | 252/8.75 |
| 4,237,016 | 12/1980 | Rudkin et al. | 252/8.8 |
| 4,268,401 | 5/1981 | Meschkat et al. | 252/8.8 |
| 4,308,024 | 12/1981 | Wells | 252/8.8 |
| 4,427,558 | 1/1984 | David | 252/8.8 |
| 4,497,718 | 2/1985 | Neiditch et al. | 252/8.75 |
| 4,547,300 | 10/1985 | Lareau | 252/8.8 |

FOREIGN PATENT DOCUMENTS 1494058 1/1976 United Kingdom .

*Primary Examiner*—Josephine Barr

*Attorney, Agent, or Firm*—Merchant, Gould, Smith, Edell, Welter & Schmidt

[57] ABSTRACT

A stable, substantially homogeneous, solid, cast fabric softening composition containing a cationic surfactant and a $C_{4-7}$ saturated dicarboxylic acid and a method of making and using the cast fabric softening composition. Preferably, the fabric softening composition further includes an inert diluent to aid in formulation and dispensing of the fabric softening composition to modify the melting point of the fabric softening composition, and to increase the solubility of the fabric softening composition.

37 Claims, 1 Drawing Sheet

FIG. 1
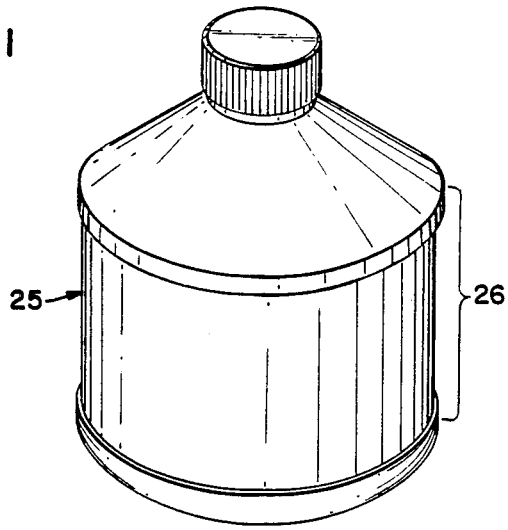
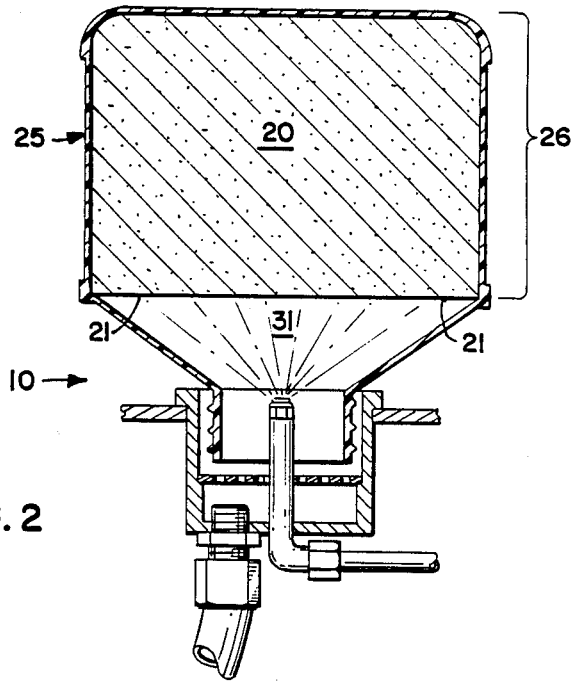
FIG. 2

INSTITUTIONAL SOFTENER CONTAINING CATIONIC SURFACTANT AND ORGANIC ACID

FIELD OF THE INVENTION

The invention relates generally to fabric conditioning compositions and methods for their preparation and use. More particularly, the invention relates to substantially homogeneous solid fabric softening compositions dispensed into a fabric cleaning machine during the rinse cycle by contacting the composition with water to dissolve the composition.

BACKGROUND OF THE INVENTION

Fabric softening compositions are used to restore softness to garments that obtain a surface tactile harshness during the washing process. Fabric softening compositions are typically contacted with the fabric either during the rinse cycle of the washing process or during drying of the washed garments. Typical commercially available liquid and powdered fabric softening compositions contain a softening agent, typically a cationic surfactant, and an acidic component. In liquid fabric softening compositions the acid typically is an 85% aqueous phosphoric acid solution. In powdered softening compositions a powdered strong acid is used.

The cationic surfactant component of the fabric softening composition is deposited onto the garment, providing a soft tactile feel. The acid component provides the treated garment with a substantially neutral pH by neutralizing the generally alkaline detergent residue remaining on the fabric from the wash cycle. A garment which is not substantially pH neutral can result in skin rashes and sores upon prolonged bodily contact.

The typical liquid, powdered or granular softening compositions are subject to inherent drawbacks such as spillage, stratification of components, etc. Additionally, such softening compositions require substantial operator handling as they are typically manually dispensed directly into the rinse water.

Accordingly, a need exists for a fabric softening composition which can (i) be manufactured into a homogeneous spill-proof composition, (ii) be used to automatically dispense appropriate proportional amounts of cationic softening agent and acid, and (iii) be used to create an appropriate concentration of the fabric softening composition in rinse water within a reasonable period of time. The fabric softening composition should be capable of meeting these requirements without interfering with fabric cleansing.

SUMMARY OF THE INVENTION

We have discovered a solid homogeneous fabric softening composition comprising a cationic surfactant and at least one solid saturated $C_{4-7}$ dicarboxylic acid compound. The cationic surfactant and the $C_{4-7}$ dicarboxylic acid compound can be blended at an elevated temperature and cast into a uniform spill-proof solid. A surface of the cast solid can be exposed to the action of an automatic water spray controlled by functioning of the cleaning machines. The automatic spray dissolves portions of the exposed surface of the cast solid creating a concentrated rinse composition comprising a concentrated solution of acid and cationic surfactant. The rinse composition can then be metered into the rinse water of the cleaning machine to form rinse water with an effective fabric softening concentration of the fabric softening composition. The $C_{4-7}$ dicarboxylic acid compound of this invention meets the criteria required for an effective fabric softening composition as set forth above and additionally has an equivalent weight (80 or less) that results in rapid neutralization of alkaline residue, has little or no odor and has physical and chemical stability in the cast form.

The fabric softening composition can contain a diluent compatible with the cationic surfactant and dicarboxylic acid which can be used to adjust release rate and the concentration of components in the rinse water. Other commonly employed fabric softening additive components can also be used.

DETAILED DESCRIPTION OF THE INVENTION INCLUDING A BEST MODE

A stable, substantially homogeneous solid cast fabric softening composition can be obtained by combining an effective proportion of a cationic surfactant, and an effective proportion of a $C_{4-7}$ dicarboxylic acid which when dissolved in rinse water can reduce surface tactile harshness and neutralize surface alkaline residue of fabric treated therein. The combination of cationic surfactant and acid results in a stable, substantially homogeneous fabric softening composition which has a softening or melting point between about 45° C. to about 100° C. and is capable of readily being dispensed into solution at a rate of about 10 to 50 grams of cationic surfactant and acid per minute. The melting point of the composition should be above about 45° C. so that the composition does not liquefy when subjected to temperatures normally encountered during transport and storage. The melting point should be below about 100° C. to conserve energy and to facilitate manufacture.

Cationic Surfactant

Cationic surfactants are a well known group of surface-active compounds which have at least one active cationic (positive ion) constituent. Cationic surfactants useful in the present invention are those which (i) exhibit effective fabric softening ability, and (ii) when combined with the other fabric softening composition components result in a stable, substantially homogeneous solid fabric softening composition preferably with a melting point between about 45° to 100° C. While any cationic surfactant meeting the two requirements above may be successfully employed in the present invention, the preferred cationic surfactants are the quaternary ammonium salts which meet the two requirements above. The most common quaternary surfactants are typically formed by reacting tertiary amines with alkyl halides and have the general structure:

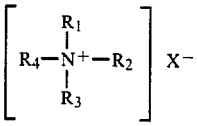

wherein X is chloride, bromide, iodide, sulfate, methyl sulfate or mixtures thereof; and $R_1$, $R_2$, $R_3$ and $R_4$ can be independently selected from $C_{1-24}$ aliphatic, normal or branched saturated or unsaturated hydrocarbon groups, alkoxy groups (R—O—), polyalkoxy groups, benzyl groups, allyl groups, hydroxyalkyl groups (HOR—), etc.

A list of quaternaries potentially useful in the present fabric softening composition include but are not limited to mono-$C_{8-22}$alkyl trimethyl quaternaries, monomethyl tri-$C_{8-22}$alkyl quaternaries, imidazolinium quaternaries, dimethyl-$C_{8-22}$alkylbenzyl quaternaries, complex diquaternaries, di-$C_{8-22}$alkyl dimethyl quaternaries, mono or dialkyl di or trialkoxy quaternaries, mono or dialkyl di or tripolyalkoxy quaternaries, (the alkoxy group being a methoxy, ethoxy or propoxy group or a hydroxyethyl or hydroxypropyl; the polyalkoxy being polyethoxy or polypropoxy group with 2–50 alkoxy groups), diamidoamine-methyl-$C_{8-22}$alkyl-quaternaries, and di-$C_{8-22}$alkyl methyl benzyl quaternaries.

The monoalkyl trimethyl quaternaries have the general formula:

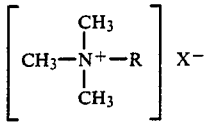

wherein X is a halide, preferably chloride, a sulfate or a methyl sulfate, and R is a $C_{12}$–$C_{22}$ aliphatic, allyl, benzyl, or $C_4$–$C_{12}$ alkyl ether propyl having the general formula $R'—O—CH_2CH_2CH_2—$.

A nonexhaustive list of monoalkyl trimethyl quaternaries includes: soya ($C_{16-22}$ unsaturated) trimethyl ammonium chloride; hydrogenated tallow ($C_{16-20}$) trimethyl ammonium chloride; palmityl ($C_{16}$) trimethyl ammonium chloride; coco ($C_{12-16}$) trimethyl ammonium chloride; tallow trimethyl ammonium chloride; allyl trimethyl ammonium chloride, and benzyl trimethyl ammonium chloride.

The monomethyl trialkyl quaternaries have the general formula:

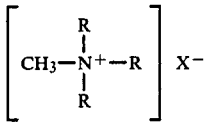

wherein: X is a halide, preferably chloride; and R is a $C_8$–$C_{18}$ alkyl.

The imidazolinium quaternaries have the general formula:

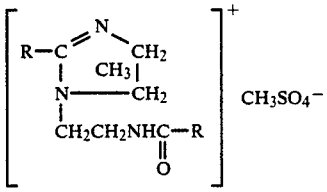

wherein: R is a $C_{12}$–$C_{18}$ aliphatic.

A nonexhaustive list of imidazolinium quaternaries includes: methyl-1-hydrogenated tallow amido ethyl-2-hydrogenated tallow imidazolinium-methyl sulfate; methyl-1-tallow amido ethyl-2-tallow imidazolinium-methyl sulfate; methyl-1-oleyl amido ethyl-2-oleyl imidazolinium-methyl sulfate; and 1-ethylene bis(2-tallow,1-methyl, imidazolinium-methyl sulfate).

The dimethyl alkyl benzyl quaternaries have the general formula:

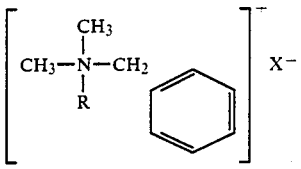

wherein: X is a halogen, preferably chloride; and R is a $C_{12}$–$C_{18}$ aliphatic.

A nonexhaustive list of dimethyl alkyl benzyl quanternaries includes: dimethyl alkyl ($C_{14}$–$C_{18}$) benzyl ammonium chloride; dimethyl alkyl ($C_{12}$–$C_{16}$) benzyl ammonium chloride, dimethyl alkyl ($C_{10}$–$C_{18}$) benzyl ammonium chloride, dimethyl stearyl benzyl ammonium chloride; and dimethyl stearyl benzyl ammonium chloride.

The complex diquaternaries have the general formula:

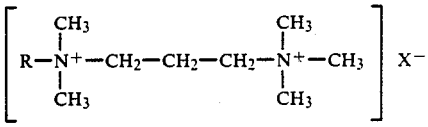

wherein: X is a halide, preferably chloride; and R is an aliphatic.

A specific example is N-tallow pentamethyl propane diammonium dichloride;

The dialkyl dimethyl quaternaries have the general formula:

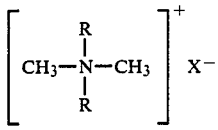

wherein: X is a halogen, preferably chloride, sulfate or methyl sulfate; and R is a $C_8$–$C_{22}$ aliphatic.

A nonexhaustive list of dialkyl dimethyl quaternaries includes: dialkyl ($C_{12}$–$C_{18}$) dimethyl ammonium chloride; di hydrogenated-tallow dimethyl ammonium chloride; dicoco dimethyl ammonium chloride; ditallow dimethyl ammonium chloride; distearyl dimethyl ammonium chloride; dicoco dimethyl ammonium chloride; dicoco dimethyl ammonium chloride; di hydrogenated-tallow dimethyl ammonium methyl sulfate; and distearyl dimethyl ammonium methyl sulfate.

The methyl dialkoxy alkyl quaternaries have the general formula:

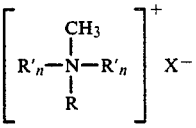

wherein: X is a halide, preferably chloride, sulfate, methyl sulfate, or ethyl sulfate; R is a $C_8$–$C_{18}$ alkyl; R' is 2-hydroxyethyl or polyethoxyethanol; and n is 1–50 polyalkoxy groups.

A nonexhaustive list of methyl dialkoxy alkyl quaternaries includes: methyl bis(2-hydroxyethyl) coco ammonium chloride; ethyl bis(polyethoxy ethanol) alyl ammonium ethyl sulfate; and methyl bis(polyethoxy ethanol) alkl ammonium chloride.

The diamidoamine based quaternaries have the general formula:

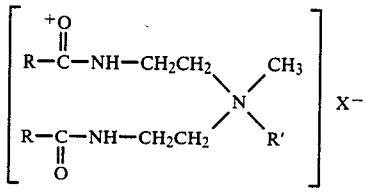

wherein: X is methyl sulfate; R is a straight chain $C_{12}$–$C_{18}$ aliphatic; and R′ is 2-hydroxyethyl or 2-hydroxypropyl.

A nonexhaustive list of diamidoamine based quaternaries includes: methyl bis(tallowamidoethyl) 2-hydroxyethyl ammonium methyl sulfate; methyl bis(oleylamidoethyl) 2-hydroxyethyl ammonium methyl sulfate; methyl bis(hydrogenated tallowamidoethyl) 2-hydroxyethyl ammonium methyl sulfate; and methyl bis(tallowamidoethyl) 2-hydroxypropyl ammonium methyl sulfate.

The dialkyl methyl benzyl quaternaries have the general formula:

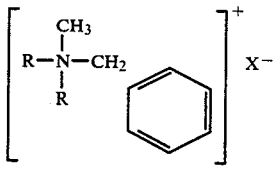

wherein: X is a halide, preferably a chloride; and R is hydrogenated tallow.

A specific example is di hydrogenated tallow methyl benzyl ammonium chloride.

The preferred cationic surfactants, for reasons of superior fabric softening ability, low cost, ease of availability, miscibility and compatibility with $C_4$–$C_7$ dicarboxylic acids, and ability to form a fabric softening composition having a melting point within the desired temperature range, are the chloride and sulfate salts of dimethyl dihydrogenated tallow ammonium and dimethyl distearyl ammonium, and mixtures thereof. The most preferred cationic surfactant is dimethyl dihydrogenated tallow ammonium chloride. Dimethyl dihydrogenated tallow ammonium chloride is available from Sherex Chemical Company as an essentially 100% active powder under the trademark ADOGEN ®442; dimethyl distearyl ammonium chloride is available from Sherex Chemical Company under the trademark AROSURF ®-TA-100; and the sulfate salts of these compounds are available from the Sherex Chemical Company under the trademark VARISOFT ®190–100P.

Acidic Component

We have found that the production of a stable, substantially homogeneous, solid, cast fabric softening composition requires an acid with a particular set of properties in combination with the cationic surfactant. First, the acid must be soluble or otherwise uniformly dispersible in molten cationic surfactant in order to successfully cast a homogeneous material. Secondly, the acid should be commercially available in a substantially water-free form. The presence of a substantial proportion of water in the fabric softening composition often results in the formation of a useless aqueous gel due to the flowable characteristic of the composition. Thirdly, the acid composition is commercially available as a solid and has a softening or melting point in excess of 120° F. Lastly, the acid should allow the formulation, in combination with the other fabric softening components, of a stable, substantially homogeneous, solid, cast fabric softening composition having a melting point of greater than about 45° C. to prevent liquefaction of the cast at normal storage temperatures, and preferably a melting point of less than about 100° C. to permit economical, energy conserving manufacture.

We have found that a stable, substantially homogeneous fabric softening composition can be made from a solid acid and a cationic surfactant if at least one solid saturated $C_{4-7}$ dicarboxylic acid compound is combined with the cationic surfactant described herein. The $C_{4-7}$ dicarboxylic acid compound of this invention meets the criteria set forth above and additionally has an equivalent weight (80 or less) that results in rapid neutralization of basic residue, has little or no odor and is stable in the cast form. The $C_{4-7}$ dicarboxylic acid compounds of this invention include succinic acid and anhydride, glutaric acid and anhydride, adipic acid and anhydride, pimelic acid and anhydride, $C_{1-3}$ alkyl substituted succinic acid and anhydride, mono $C_{1-3}$ alkyl succinic acid, 2,4-dimethyl adipic acid and anhydride, and others.

For reasons of low cost and ease of availability, the preferred acidic component comprises succinic acid, glutaric acid, adipic acid, pimelic acid and mixtures thereof. These acids often contain small amounts of other $C_{1-6}$ acids and diacids. The most preferred acidic component is a mixture of about 20 to 30 wt-% succinic acid, about 50 to 60 wt-% glutaric acid, and about 10 to 30 wt-% adipic acid available from BASF Wyandotte, under the trademark SKOLAN ®DCS. SKOLAN ®DCS has a melting or softening temperature between about 150° to 185° C.

Diluent

Preferably, the fabric softening composition further contains a diluent. The diluent can serve the multiple functions of (i) aiding in formulation and dispensing of a composition with the appropriate wt-% of cationic surfactant and acid, (ii) modifying the melting point of the fabric softening composition so that it falls within the desired range of about 45° to about 100° C., and (iii) aiding in increasing the solubility of the fabric softening composition so that the rate of dissolution falls within a preferred range of about 10 to 50 grams active components (cationic surfactant and acid per minute. The diluent should be substantially odorless, compatible with the cationic surfactant and acid and should not interfere with the cleansing or softening of the fabric. Any compound which meets these criteria can successfully be utilized in the composition. A nonlimiting list of diluents which may be utilized includes glycols, alcohols, ethoxylated alcohols, fatty acids, and nonionic surfactants. However, some of the fatty acids and some of the alcohols tend to contribute an obnoxious odor. For reasons of high water solubility, compatibility with the cationic surfactants and acids, and ability to alter the melting point of the fabric softening composition to between 45° to 100° C., the preferred diluents include $C_{4-10}$ alkylene glycols, n-$C_{6-12}$ alkanols and alkoxylated $C_{8-22}$ alcohols containing an average of 1 to 4 moles of alkylene oxide. For reasons of cost and ease of availability hexylene glycol is the most preferred.

While not intending to be limited thereby, I believe that incorporation of a diluent having a melting or softening temperature at or below the temperature of the dissolving water (about 40° to 90° C.) significantly increases the dissolution rate of the fabric softening composition due to the rapid dissolution or dispersion of the diluent in the dissolving water. Dissolution of the diluent increases the amount of dissolvable surface area and also tends to create small particles of acid and softener which may be dispensed into the rinse water and readily dissolved.

While the fabric softening composition may comprise nearly 100% of some diluents, for reasons of cost, dispensing practicality, and ability to result in a solid product, when a diluent is utilized the fabric softening composition preferably comprises about 2 to 25 wt-% diluent, and most preferably about 5 to 20 wt-% diluent.

In addition to the cationic surfactant, acid and diluent, additional commonly employed fabric softener additives may be incorporated in effective minor amounts in the fabric softening composition. Such additives include sequestering agents, optical brighteners, dyes, perfumes, etc.

Preparation

Generally, the fabric softening composition may be prepared by any convenient method. The components need only be liquefied, well mixed and cast. Due to the high melting point of the saturated dicarboxylic acids utilized in the present invention (about 185° C. for succinic, about 97° C. for glutaric, about 152° C. for adipic, and about 105° C. for pimelic), the preferred method comprises: (i) liquefying the cationic surfactant, (ii) slowly adding the acid component into the liquefied cationic surfactant to form a mixture of the acid component in the surfactant (iii) blending the mixture until a homogeneous solution is formed, (iv) casting the solution into an appropriate receptacle, and (v) allowing the cast solution to solidify. When a diluent is employed it is preferably blended into the liquefied cationic surfactant prior to addition of the acid component. Preferably the solubility of the acid component in the surfactant is increased and the surfactant melted, if necessary, by heating the surfactant above its melting point prior to addition of diluent and acid.

The concentration of both cationic surfactant and acid in the rinse water should be carefully controlled. With respect to the concentration of cationic surfactant, insufficient surfactant results in ineffectively softened fabric while an excess results in yellowing and waterproofing of the fabric. With respect to the concentration of acid, the amount of acid added to the rinse water should be that amount sufficient to neutralize the alkaline detergent residue remaining in the rinse water from the wash cycle without creating an overly acidic rinse solution. Addition of the fabric softening composition to the rinse water should result in a substantially neutral bath having a pH of about 6 to 7 and preferably about 6 to 6.5. Both alkaline and acidic garments can result in skin rashes and sores after prolonged contact with the skin. In order to dispense the appropriate amounts of both cationic surfactant and acid the relative proportion of each must be controlled. While the most effective weight of cationic surfactant to acid depends upon many variables, including the cationic surfactant and acid employed, the detergent employed, the washing process employed and the fabric being softened, typically effective weight ratios are between about one part by weight cationic surfactant to about 1 to 10 parts by weight acid. Preferably the fabric softener comprises about one part by weight cationic surfactant to about 3 to 8 parts by weight acid. Most preferably, the fabric softener comprises about one part by weight cationic surfactant to about 5 to 7 parts by weight acid.

The preferred fabric softening composition comprises about 5 to 25 wt-% cationic surfactant selected from the group of dimethyl dihydrogenated tallow ammonium salts and dimethyl distearyl ammonium salts and mixtures thereof, about 10 to 90 wt-% acid comprising a mixture of $C_{4-7}$ dicarboxylic acids, and about 2 to 20 wt-% of a $C_{4-10}$ alkylene glycol. Most preferably the fabric softening composition comprises about 10 to 15 wt-% dimethyl dihydrogenated tallow ammonium chloride, about 70 to 80 wt-% acid comprising a mixture of about 20 to 30 wt-% succinic acid, about 50 to 60 wt-% glutaric acid, and about 10 to 30 wt-% adipic acid, and about 5 to 20 wt-% hexylene glycol.

The fabric softening composition may be cast either into a mold from which it is subsequently removed and placed into a separate container used for shippng and storage or may be cast directly into the shipping and storage container. Preferably the fabric softening composition is cast directly into the shipping and storage container in order to eliminate the transfer process step.

The container may be made of any material capable of housing the fabric softening composition, including but not limited to aluminum, steel, glass and structural resins such as a polyolefin (polyethylene), a polyester such as in mylar, a polyamide (nylon), etc. When the fabric softening composition is cast directly into the container the container must also be capable of withstanding the cast temperature of the molten composition. For reasons of cost the preferred material is polyethylene or polypropylene, with polypropylene being most preferred. For dispensing from the preferred spray-type dispenser the container must leave at least one surface of the fabric softening composition contained therein exposed, preferably leaving only a single exposed surface, so that water may be impinged upon the fabric softening composition. The fabric softening composition may be cast into any suitable size and shape but, for reasons of shortening the time period necessary to complete solidification of the cost, presenting an exposed surface sufficient to allow an effective dispensing rate, and ease of shipping and handling, the preferred size of the fabric softening cast is between about 3 to 10 liters with an exposed surface area of about 50 to 500 $cm^2$ and most preferably between about 3 to 4 liters with an exposed surface area of about 150 to 200 $cm^2$.

Dispensing

The fabric softening composition of the present invention is intended for use in the rinse water employed during the rinse cycle of a washing process.

The fabric softening composition must be dissolved or otherwise dispersed in the rinse water to impart its fabric softening property onto the fabric. Therefore, the formulation and means of dispensing must be capable of delivering a sufficient amount of the fabric softening composition into the rinse water during the rinse cycle to effectively soften the fabric. The fabric softening composition may be dissolved prior to use to ensure a ready supply but such a system destroys many of the advantages offered by casting the fabric softening composition such as reducing or eliminating spillage of the composition. The desired rate of dispensing depends upon several variables, the most important being the capacity of the cleansing machine. Typical commercial and industrial cleansing machines have about a 2-minute rinse cycle. Preferably an effective fabric softening amount of the fabric softening composition is delivered into the rinse water within the first minute of the rinse cycle. To satisfy the vast majority of institutional and commercial cleansing machines the fabric softening composition should be capable of readily dissolving into the rinse water directly from the solid form at a rate of about 10 to 50 grams of active components (cationic surfactant and acid) per minute, most preferably about 15 to 35 grams of cationic surfactant and acid per minute, to permit simultaneous creation and utilization of the fabric softening solution and allow sufficient contact of the fabric softening composition with the fabric. The rate of dispensing into solution is dependent upon several variables which includes but it not limited to (i) formulation of the composition, (ii) method of dispensing employed, (iii) shape of the cast composition, and (iv) temperature of the solvent; all of which may be adjusted to reach the desired dispensing rate and compensate for changes in the other variables.

As shown in FIG. 2 a preferred means of dispensing the fabric softening composition into the rinse water comprises impinging a water spray 31 upon an exposed surface(s) 21 of the solid block of fabric softening composition 20, thereby dissolving the fabric softening composition 20 and forming a concentrated solution which then, immediately upon being formed, passes out of the dispenser 10 and into the rinse water. Such dispensers are disclosed in U.S. Pat. Nos. 4,426,362, 4,569,780, 4,569,781 and copending U.S. applications Ser. Nos. 817,350, 796,017 and 817,399. To achieve the desired dispensing rate of active components per minute the concentrated solution should contain about 2 to 15 grams active components per liter of water spray, or more preferably, about 3 to 175 grams active components per liter of water spray. Concentration of the concentrated solution can be affected by several variables which include formulation of the cast solid, and temperature and pressure of the water being sprayed.

The most preferred means of dispensing is disclosed in copending U.S. patent application Ser. No. 817,399 wherein (i) the fabric softening composition is cast in a right angle cylindrical container from which the fabric softener is dispensed, (ii) an exposed surface of the fabric softening composition is placed upon and supportably engaged by a right angle cylindrical screen, and (iii) water is sprayed onto the exposed surface of the fabric softening composition, dissolving the composition and forming a concentrated fabric softening solution. Such a dispenser allows the fabric softening composition to be dispensed without being removed from the container and dispenses a concentrated fabric softening solution of substantially constant concentration over the lifetime of the container by maintaining a constant distance between the dissolving exposed surface of the fabric softening composition and the spray nozzle.

Further, while the most effective amount of active components to be added to the rinse water is dependent upon many variables including the cationic surfactant and acid employed, the detergent employed and the fabric being softened, typically effective amounts are about 0.5 to 5.0 grams cationic surfactant and acid per kilogram of fabric, with about 0.5 to 1.5 grams cationic surfactant and acid per kilogram fabric being preferred. Of course, the use of a diluent in the fabric softening composition would result in a proportional increase in the total weight of cast fabric softener required per kilogram fabric.

EXAMPLE I

Into a 4,000 milliliter liquid mixing kettle agitated by mechanical stirrer and heated by atmospheric steam was placed about 350 grams of AROSURF ®TA-100, dimethyl distearyl ammonium chloride available from Sherex Chemical Co. Inc. The AROSURF ®TA-100 was heated to a temperature of about 80°-95° C. until completely liquefied. About 2,150 grams of SOKALAN ®DCS, a mixture of about 55 wt-% glutaric acid, 26 wt-% succinic acid, and 18% adipic acid available from BASF Wyandotte, was slowly added under constant agitation to the liquefied AROSURF ®TA-100 over a period of about 15 minutes. The mixture was then cooled to about 80° C. and all 2,500 grams of the mixture poured into a 3.0 liter polypropylene container shown in FIG. 1, making sure that the mixture was housed completely within cylindrical portion 26 of container 25 shown in FIGS. 1 and 2, to ensure a constant exposed fabric softening composition surface area throughout the life of the composition. The mixture was allowed to solidify at room temperature, forming a homogeneous solid cast fabric softening composition.

EXAMPLE II

Into a 4,000 milliliter liquid mixing kettle agitated by mechanical stirrer and heated by atmospheric steam was placed about 300 grams of ADOGEN ®442, dimethyl dihydrogenated tallow ammonium chloride available from the Sherex Chemical Co. Inc. and about 325 grams of hexylene glycol. The ADOGEN ®442 and hexylene glycol were heated to a temperature of about 80°-95° C. until completely liquefied. About 1,875 grams of SOKALAN ®DCS, a mixture of about 55 wt-% glutaric acid, 26 wt-% succinic acid, and 18% adipic acid available from BASF, was slowly added under constant agitation to the liquefied ADOGEN ®442 and hexylene glycol mixture over a period of about 15 minutes. The ADOGEN ®442, hexylene glycol and SOKALAN ®DCS mixture was then cooled to about 80° C. and poured into about a 3.0 liter polypropylene container shown in FIG. 1, making sure that the mixture was housed completely within cylindrical portion 26 of container 25 to ensure a constant exposed fabric softening composition surface area throughout the life of the composition. The mixture was alowed to solidify at room temperature, forming a homogeneous solid cast fabric softening composition with a melting point of about 66° C.

EXAMPLE III

A solid cast fabric softening composition was made in accordance with Example II except that the 325 grams of hexylene glycol was replaced with about 325 grams of heptanoic acid. Solidification of the mixture resulted in a homogeneous, solid cast fabric softening composition. However, the heptanoic acid contributed an obnoxious odor to the composition.

EXAMPLE IV

A solid cast fabric softening composition was made in accordance with Example II except that the 325 grams of hexylene glycol was replaced with about 325 grams of valeric acid. Solidification of the mixture resulted in a homogeneous, solid cast fabric softening composition. However, the valeric acid contributed an obnoxious odor to the composition.

EXAMPLE V

A solid cast fabric softening composition was made in accordance with Example II except that the 325 grams of hexylene glycol was replaced with about 325 grams of decanoic acid. Solidification of the mixture resulted in a homogeneous, solid, cast fabric softening composition. However, the decanoic acid contributed an obnoxious odor to the composition.

EXAMPLE VI

A solid cast fabric softening composition was made in accordance with Example II except that the 325 grams of hexylene glycol was replaced with about 325 grams of n-decanol. Solidification of the mixture resulted in a homogeneous, solid cast fabric softening composition.

EXAMPLE VII

A solid cast fabric softening composition was made in accordance with Example II except that the 325 grams of hexylene glycol was replaced with about 325 grams of n-octanol. Solidification of the mixture resulted in a homogeneous, solid, cast fabric softening composition. However, the n-octanol contributed an obnoxious odor to the composition.

EXAMPLE VIII

A solid cast fabric softening composition was made in accordance with Example II except that the 325 grams of hexylene glycol was replaced with about 325 grams of n-hexanol. Solidification of the mixture resulted in a homogeneous, solid, cast fabric softening composition and a closed cup flash point of 65° C.

EXAMPLE IX

A solid cast fabric softening composition was made in accordance with Example II except that the 325 grams of hexylene glycol was replaced with about 325 grams of NEODOL®25-3 (a $C_{12-15}$ alcohol containing 3 moles of ethylene oxide) manufactured and sold by Shell Chemical Co. Solidification of the mixture resulted in a homogeneous, solid cast fabric softening composition.

EXAMPLE X

A solid cast fabric softening composition was made in accordance with Example II except that the 300 grams of ADOGEN 442 was replaced with about 300 grams of AROSURF®-TA-100, dimethyl distearyl ammonium chloride available from Sherex Chemical Co. Inc. Solidification of the mixture resulted in a homogeneous, solid cast fabric softening composition.

EXAMPLE XI

A solid cast fabric softening composition was made in accordance with Example II except that the 325 grams of hexylene glycol was replaced with 325 grams of NEODOL 25-3, $C_{12-15}$ alcohol containing 3 moles of ethylene oxide manufactured and sold by Shell Chemical Co., and the 300 grams of ADOGEN®442 was replaced with about 300 grams of AROSURF®TA-100, dimethyl distearyl ammonium chloride available from Sherex Chemical Co. Inc. Solidification of the mixture resulted in a homogeneous, solid cast fabric softening composition.

EXAMPLE XII

The solid cast fabric softening compositions made in accordance with Examples I–XI were each individually placed in a spray type dispenser as shown in FIG. 2. The exposed surface 21 of the solid cast fabric softening composition 20 was then sprayed with water at about 55° C. and under about 15 psi pressure for about 5 minutes. The composition and container were removed from the dispenser and weighed. The product was returned to the dispenser and again sprayed with water at about 55° C. and under about 15 p.s.i. pressure for 1 minute. The composition and container were removed from the dispenser and weighed. The difference in weight between the first and second weighings was recorded. The pressure of the water spray was then increased to about 25 psi, the composition and container returned to the dispenser and sprayed for a third time with water at about 55° C. and under about 25 psi pressure for 1 minute. The composition and container were removed from the dispenser and weighed. The difference between the second and third weighings was recorded. The difference in weight between the first and second weighing represents a grams per minute dispensing rate for that solid cast fabric softening composition at 15 p.s.i. and the difference in weight between the second and third weighings represents a gram per minute dispensing rate for that solid cast fabric softening composition at 25 p.s.i.

The dispensing rate of each of the fabric softening compositions at both 15 and 25 p.s.i. spray pressure are tabulated in Table 1, including a rate of dispensing in grams per minute for the total cast composition and also for the active components only (cationic surfactant and acid only, excluding diluent). As can readily be seen from Table 1, the dispensing rate of the active components increases by about a factor of 3 to 4 when an appropriate diluent is employed at a concentration of about 13 wt-% of the composition.

TABLE 1

| | Grams of Cast Material Dispensed per 60 Seconds Spray | | Grams of Cationic Surfactant and Dicarboxylic Acid Dispensed per 60 Seconds Spray | |
|---|---|---|---|---|
| Composition | (@15 psi) | (@ 25 psi) | (@ 15 psi) | (@ 25 psi) |
| Example I | 7.2 | 11.4 | 7.2 | 11.4 |
| Example II | 33.6 | 44.8 | 29.2 | 39.0 |
| Example III | 27.4 | 38.5 | 23.8 | 33.5 |
| Example IV | 29.2 | 37.0 | 25.4 | 29.7 |
| Example V | 26.5 | 39.0 | 23.0 | 33.9 |
| Example VI | 29.5 | 34.2 | 25.7 | 29.7 |
| Example VII | 35.0 | 39.0 | 30.4 | 33.9 |
| Example VIII | 42.0 | 49.0 | 36.5 | 42.6 |
| Example IX | 38.4 | 49.2 | 33.4 | 42.8 |
| Example X | 36.2 | 46.7 | 31.5 | 40.6 |
| Example XI | 37.3 | 48.7 | 32.4 | 42.4 |

The foregoing Examples and discussion provide the detailed discussion of the preferred embodiments of the invention and provide a best mode. Since many embodiments of the invention can be made without departing from the spirit and scope of the invention, the invention resides in the claims hereinafter appended.

I claim:

1. A substantially homogeneous, solid, cast fabric softening composition capable of softening fabrics when solubilized in rinse water and used to rinse the fabrics, comprising:

(a) an effective fabric softening proportion of a cationic surfactant; and (b) an effective proportion of a $C_{4-7}$ saturated dicarboxylic acid compound sufficient to substantially neutralize the rinse water;

wherein the cast solid is conformed to permit contact between the cast solid and a sufficient amount of water to form a fabric softening, rinse water neutralizing aqueous solution.

2. The composition of claim 1 wherein the fabric softening composition further comprises a diluent.

3. The composition of claim 2 wherein the diluent comprises a room temperature solid having a softening point below about 20° C.

4. The composition of claim 1 further comprising a container surrounding the solid cast fabric softening composition, the container leaving at least one surface of the fabric softening composition exposed.

5. The composition of claim 1 wherein the fabric softening composition has a softening point between about 45° to 100° C.

6. The composition of claim 1 comprising about 1 part by weight cationic surfactant per each 1 to 10 parts by weight of acid compound.

7. The composition of claim 1 which comprises about 1 part by weight cationic surfactant per each 5 to 7 parts by weight of acid compound.

8. The composition of claim 3 wherein the fabric softening composition comprises:

(a) about 5 to 25 wt-% cationic surfactant;

(b) about 10 to 90 wt-% dicarboxylic acid compound; and (c) about 2 to 20 wt-% diluent; based upon the fabric softening composition.

9. The composition of claim 4 wherein the fabric softening composition comprises:

(a) about 10 to 15 wt-% cationic surfactant;

(b) about 70 to 80 wt-% dicarboxylic acid compound;

(c) about 5 to 20 wt-% diluent; based upon the fabric softening composition.

10. The composition of claim 1 wherein the cationic surfactant comprises a quaternary ammonium salt compound selected from the group consisting of dimethyl dihydrogenated tallow ammonium salts, dimethyl distearyl ammonium salts, and mixtures thereof.

11. The composition of claim 8 wherein the cationic surfactant comprises a quaternary ammonium salt compound selected from the group consisting of dimethyl dihydrogenated tallow ammonium salts, dimethyl distearyl ammonium salt, and mixtures thereof.

12. The composition of claim 9 wherein the cationic surfactant comprises a quaternary ammonium salt compound selected from the group consisting of dimethyl dihydrogenated tallow ammonium salts, dimethyl distearyl ammonium salts, and mixtures thereof.

13. The composition of claim 8 wherein the dicarboxylic acid compound comprises an acid selected from the group consisting of succinic acid, glutaric acid, adipic acid, pimelic acid and mixtures thereof.

14. The composition of claim 8 wherein the dicarboxylic acid compound comprises a mixture of about 20 to 30 wt-% succinic acid, about 50 to 60 wt-% glutaric acid, and about 10 to 30 wt-% adipic acid, based upon the dicarboxylic acid component.

15. The composition of claim 9 wherein the dicarboxylic acid comopund comprises a mixture of about 20 to 30 wt-% succinic acid, about 50 to 60 wt-% glutaric acid, and about 10 to 30 wt-% adipic acid, based upon the dicarboxylic acid component.

16. The composition of claim 2 wherein the diluent comprises a diluent selected from the group consisting of $C_{4-10}$ alkylene glycols, $C_{4-24}$ alcohols, alkoxylated $C_{4-24}$ alcohols, $C_{6-22}$ fatty acids, nonionic surfactants and mixtures thereof.

17. The composition of claim 16 wherein the diluent comprises hexylene glycol.

18. A substantially homogeneous, solid, fabric softening composition cast in a container, having at least one surface of the fabric softening composition exposed, the fabric softening composition comprising:

(a) about 10 to 15 wt-% dimethyl dihydrogenated tallow ammonium chloride;

(b) about 70 to 80 wt-% of a mixture of about 20 to 30 wt-% succinic acid, about 50 to 60 wt-% glutaric acid and about 10 to 30 wt-% adipic acid, based upon the dicarboxylic acid component; and (c) about 5 to 20 wt-% hexylene glycol, based upon the cast fabric softening composition; wherein the composition is cast within a container adapted for attachment to a dispenser comprising a spray means for impinging a spray of water upon a surface of the composition to create a concentrated fabric softening solution.

19. A method of manufacturing a substantially homogeneous, solid, cast fabric softening composition, comprising the steps of:

(a) blending an effective fabric softening proportion of a cationic surfactant and an effective rinse water pH neutralizing proportion of a $C_{4-7}$ saturated dicarboxylic acid compound at an elevated temperature to form a substantially homogeneous melt composition;

(b) placing the melt composition into a container that leaves at least one surface of the melt composition exposed; and (c) solidifying the melt composition to form the substantially homogeneous, solid, cast fabric softening composition.

20. The method of claim 19 further comprising the step of blending a diluent with the cationic surfactant and acid.

21. The method of claim 20 wherein the diluent comprises a room temperature solid having a softening point below about 20° C.

22. The method of claim 19 wherein the cationic surfactant and acid are blended at a temperature between about 45° to 110° C.

23. The method of claim 19 wherein the fabric softening composition comprises about one part by weight cationic surfactant per 1 to 10 parts by weight acid compound.

24. The method of claim 19 wherein the fabric softening composition comprises about one part by weight cationic surfactant per 5 to 7 parts by weight acid compound.

25. The method of claim 20 wherein the fabric softening composition comprises:

(a) about 5 to 25 wt-% cationic surfactant;

(b) about 10 to 90 wt-% dicarboxylic acid compound;

(c) about 2 to 20 wt-% inert diluent each based upon the fabric softening composition.

26. The method of claim 19 wherein the cationic surfactant comprises a quaternary ammonium compound salt is selected from the group consisting of dimethyl dihydrogenated tallow ammonium salts, dimethy distearyl ammonium salts and mixtures thereof.

27. The method of claim 24 wherein the cationic surfactant comprises a quaternary ammonium compound salt selected from the group consisting of dimethyl dihydrogenated tallow ammonium salts and dimethyl distearyl ammonium salts and mixtures thereof.

28. The method of claim 25 wherein the cationic surfactant comprises a quaternary ammonium compound salt selected from the group consisting of dimethyl dihydrogenated tallow ammonium salts and dimethyl distearyl ammonium salts and mixtures thereof.

29. The method of claim 24 wherein the dicarboxylic acid compound is selected from the group consisting of succinic acid, glutaric acid, adipic acid, pimelic acid or mixtures thereof.

30. The method of claim 20 wherein the dicarboxylic acid comprises a mixture of about 20 to 30 wt-% succinic acid, about 50 to 60 wt-% glutaric acid and about 10 to 30 wt-% adipic acid, based upon the dicarboxylic acid component.

31. The method of claim 20 wherein the dicarboxylic acid comprises a mixture of about 20 to 30 wt-% succinic acid, about 50 to 60 wt-% glutaric acid and about 10 to 30 wt-% adipic acid, based upon the dicarboxylic acid component.

32. The method of claim 25 wherein the diluent comprises hexylene glycol.

33. A method of manufacturing an article of commerce comprising a substantially homogeneous, solid, fabric softening composition cast in a container, comprising the steps of:

(a) heating, at a temperature between about 35° C. to 100° C., about 10 to 15 parts by weight of a quaternary ammonium compound selected from the group consisting of dimethyl dihydrogenated tallow ammonium salts, dimethyl distearyl ammonium salts, and mixtures thereof to form a melt;

(b) distributing about 5 to 20 parts by weight hexylene glycol throughout the melt;

(c) distributing about 70 to 80 parts by weight of a dicarboxylic acid compound comprising a mixture of about 20 to 30 wt-% succinic acid, about 50 to 60 wt-% glutaric acid, and about 10 to 30 wt-% adipic acid throughout the melt to form a substantially homogeneous melt composition;

(d) placing the substantially homogeneous melt composition into the container; and (e) solidifying the melt to form the substantially homogeneous, solid, cast fabric softening composition.

34. A method of softening washed fabrics comprising the steps of:

(a) impinging a water spray upon at least one surface of the fabric softening composition of claim 1 to dissolve the fabric softening composition and form a concentrated softening solution containing about 2 to 25 grams cationic surfactant and dicarboxylic acid per liter of solution;

(b) introducing about 0.5 to 5.0 grams cationic surfactant and dicarboxylic acid per kilogram of washed fabrics into rinse water utilized to rinse the washed fabrics; and (c) agitating the washed fabrics in the rinse water.

35. A method of softening washed fabrics comprising the steps of:

(a) impinging a water spray upon at least one surface of the fabric softening composition of claim 8 to dissolve the fabric softening composition and form a concentrated softening solution containing about 3 to 17.5 grams cationic surfactant and dicarboxylic acid per liter of solution;

(b) introducing about 0.5 to 1.5 grams cationic surfactant and dicarboxylic acid per kilogram of washed fabrics into rinse water utilized to rinse the washed fabrics;

(c) agitating the washed fabrics in the rinse water.

36. A method of softening washed fabrics comprising the steps of:

(a) impinging water upon at least one surface of the fabric softening composition of claim 9 to dissolve the fabric softening composition and form a concentrated softening solution containing about 3 to 17.5 grams cationic surfactant and dicarboxylic acid per liter of solution;

(b) introducing about 0.5 to 1.5 grams cationic surfactant and dicarboxylic acid per kilogram of washed fabrics into rinse water utilized to rinse the washed fabrics;

(c) agitating the washed fabrics in the rinse water.

37. A method of softening washed fabrics comprising the steps of:

(a) impinging water upon at least one surface of the fabric softening composition of claim 17 to dissolve the fabric softening composition and form a concentrated softening solution containing about 3 to 17.5 grams cationic surfactant and dicarboxylic acid per liter of solution;

(b) introducing about 0.5 to 1.5 grams cationic surfactant and dicarboxylic acid per kilogram of washed fabrics into rinse water utilized to rinse the washed fabrics; and (c) agitating the washed fabrics in the rinse water.

* * * * *